US007071610B2

(12) United States Patent
Takenaka et al.

(10) Patent No.: US 7,071,610 B2
(45) Date of Patent: Jul. 4, 2006

(54) IMAGE DISPLAY DEVICE AND MANUFACTURING METHOD FOR IMAGE DISPLAY DEVICE

(75) Inventors: Shigeo Takenaka, Fukaya (JP); Masaru Nikaido, Yokosuka (JP); Satoshi Ishikawa, Fukaya (JP); Satoko Oyaizu, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/965,262

(22) Filed: Oct. 15, 2004

(65) Prior Publication Data

US 2005/0046333 A1 Mar. 3, 2005

Related U.S. Application Data

(63) Continuation of application No. PCT/JP03/04110, filed on Mar. 31, 2003.

(30) Foreign Application Priority Data

Apr. 17, 2002 (JP) ..... 2002-114981

(51) Int. Cl.
*H01J 1/304* (2006.01)
*H01J 1/62* (2006.01)

(52) U.S. Cl. ..... 313/496; 313/495; 313/309; 313/310

(58) Field of Classification Search ..... 313/495–497, 313/309–311
See application file for complete search history.

(56) References Cited

U.S. PATENT DOCUMENTS

| | | | | |
|---|---|---|---|---|
| 5,448,132 | A * | 9/1995 | Komatsu | 313/495 |
| 5,814,924 | A * | 9/1998 | Komatsu | 313/309 |
| 6,583,549 | B1 * | 6/2003 | Takenaka et al. | 313/422 |
| 6,664,727 | B1 * | 12/2003 | Nakamoto | 313/495 |
| 2001/0041490 | A1 | 11/2001 | Nomura et al. | |

FOREIGN PATENT DOCUMENTS

| | | |
|---|---|---|
| EP | 1 168 410 A1 | 1/2002 |
| EP | 1 189 255 A1 | 3/2002 |
| JP | 4-36942 | 2/1992 |
| JP | 9-180655 | 7/1997 |
| JP | 10-283954 | 10/1998 |
| JP | 2000-251680 | 9/2000 |
| JP | 2001-35425 | 2/2001 |
| JP | 2002-198001 | 7/2002 |
| TW | 476053 | 2/2002 |
| WO | WO 01/08193 A1 | 2/2001 |

* cited by examiner

*Primary Examiner*—Karabi Guharay
(74) *Attorney, Agent, or Firm*—Oblon, Spivak, McClelland, Maier & Neustadt, P.C.

(57) ABSTRACT

A vacuum envelope includes a first substrate provided with an image display surface and a second substrate opposed to the first substrate with a gap and provided with a plurality of electron sources. The second substrate is formed of a metal substrate, of which a setting surface provided with the electron sources is covered by an insulating layer.

9 Claims, 3 Drawing Sheets

IMAGE DISPLAY DEVICE AND MANUFACTURING METHOD FOR IMAGE DISPLAY DEVICE

CROSS REFERENCE TO RELATED APPLICATIONS

This is a Continuation Application of PCT Application No. PCT/JP03/04110, filed Mar. 31, 2003, which was published under PCT Article 21(2) in Japanese.

This application is based upon and claims the benefit of priority from prior Japanese Patent Application No. 2002-114981, filed Apr. 17, 2002, the entire contents of which are incorporated herein by reference.

BACKGROUND OF THE INVENTION

1. Field of the Invention

The present invention relates to a flat image display device and a method of manufacturing the image display device, and more particularly, to a flat image display device, having substrates opposed to each other and a plurality of electron sources arranged on the inner surface of one substrate, and a method of manufacturing the image display device.

2. Description of the Related Art

In recent years, there have been demands for image display devices for high-grade broadcasting or high-resolution versions therefor, which require higher screen display performance. To meet these demands, the screen surface must be flattened and enhanced in resolution. At the same time, the devices must be lightened in weight and thinned.

Accordingly, various flat image display devices have been developed as a next generation of light-weight, thin image display devices to replace cathode-ray tubes (hereinafter referred to as CRT). These image display devices include a liquid crystal display (hereinafter referred to as LCD), plasma display panel (hereinafter referred to as PDP), display device that utilizes the electroluminescence (EL) phenomenon of phosphors, field emission display (hereinafter referred to as FED), surface-conduction electron emission display (hereinafter referred to as SED), etc. In the LCD, the intensity of light is controlled by utilizing the orientation of a liquid crystal. In the PDP, phosphors are caused to glow by ultraviolet rays that are produced by plasma discharge. In the FED, phosphors are caused to glow by electron beams that are emitted from field-emission electron emitting elements. In the SED, which is a kind of an FED, phosphors are caused to glow by electron beams that are emitted from surface-conduction electron emitting elements.

For example, the SED has a first substrate and a second substrate that are opposed to each other with a given gap between them. Usually, these substrates are formed of a glass plate with a thickness of about 2.8 mm each, and have their respective peripheral edge portions joined together directly or by means of a sidewall in the form of a rectangular frame, thereby constituting a vacuum envelope. A phosphor layer that functions as an image display surface is formed on the inner surface of the first substrate. A large number of electron emitting elements for use as electron sources that excite the phosphors to luminescence are provided on the inner surface of the second substrate.

A plurality of spacers for use as support members are arranged between the first substrate and the second substrate in order to support atmospheric load that acts on these substrates. In displaying an image on this SED, an anode voltage is applied to the phosphor layer, and electron beams emitted from the electron emitting elements are accelerated and run against the phosphor layer by the anode voltage. Thereupon, the phosphor glows and displays the image.

According to the SED of this type, the size of each electron emitting element is on the micrometer order, and the distance between the first substrate and the second substrate can be set on the millimeter order. Thus, the SED, compared with a CRT that is used as a display of an existing TV or computer, can achieve higher resolution, lighter weight, and reduced thickness.

In the flat image display device of this type, as described above, a glass plate is used as each of the first and second substrates. In this case, however, it is hard to make the substrates thinner than the existing ones on account of strength problems. This constitutes a hindrance to further reductions in the thickness and weight of the image display device. Further, the strength problems of the glass substrates place many restrictions on the pitch, width, diameter, height dispersion, etc. of the spacers that are arranged between the first substrate and the second substrate, thereby retarding enhancement of precision and reduction in cost. Further, a glass plate, compared with a metal plate, entails more troublesome operations for working, formation, etc., and reduction of its manufacturing cost requires some countermeasure. As is generally known, glass plates easily break and are awkward to handle during manufacturing processes.

BRIEF SUMMARY OF THE INVENTION

The present invention has been made in consideration of these circumstances, and its object is to provide a flat image display device, capable of being reduced in thickness and weight and lowered in manufacturing cost to provide for future higher precision performance, and a method of manufacturing the image display device.

According to an aspect of the present invention, an image display device comprises an envelope which has a first substrate provided with an image display surface and a second substrate opposed to the first substrate with a gap and provided with a plurality of electron sources and is kept in a vacuum inside. The second substrate is formed of a metal substrate having a setting surface provided with the electron sources, at least the setting surface being covered by an insulating layer.

According to another aspect of the invention, a method of manufacturing an image display device which comprises an envelope which has a first substrate provided with an image display surface and a second substrate opposed to the first substrate with a gap and provided with a plurality of electron sources and is kept in a vacuum inside, the method comprises: preparing a metal substrate having a desired thickness; forming an insulating layer on at least one surface of the metal substrate; and forming on the insulating layer the electron sources and wires which drive the electron sources, thereby constituting the second substrate.

According to the image display device and the manufacturing method of the image display device described above, the second substrate is formed of a composite material that is obtained by coating a metal substrate with an insulating material. As compared with a case where a glass plate or the like is used, therefore, the mechanical strength of the second substrate can be enhanced considerably, so that the second substrate can be made thinner. Accordingly, the entire image display device can be made thinner and lighter in weight. At the same time, the second substrate, compared with the glass plate, can be worked more easily and ensures easier formation of the wires, so that its manufacturing cost can be lowered, and the substrate can be easily handled during manufacturing processes.

DETAILED DESCRIPTION OF THE INVENTION

Embodiments in which this invention is applied to an SED, a kind of an FED for use as a flat image display device, will now be described with reference to the drawings.

Figure 1:
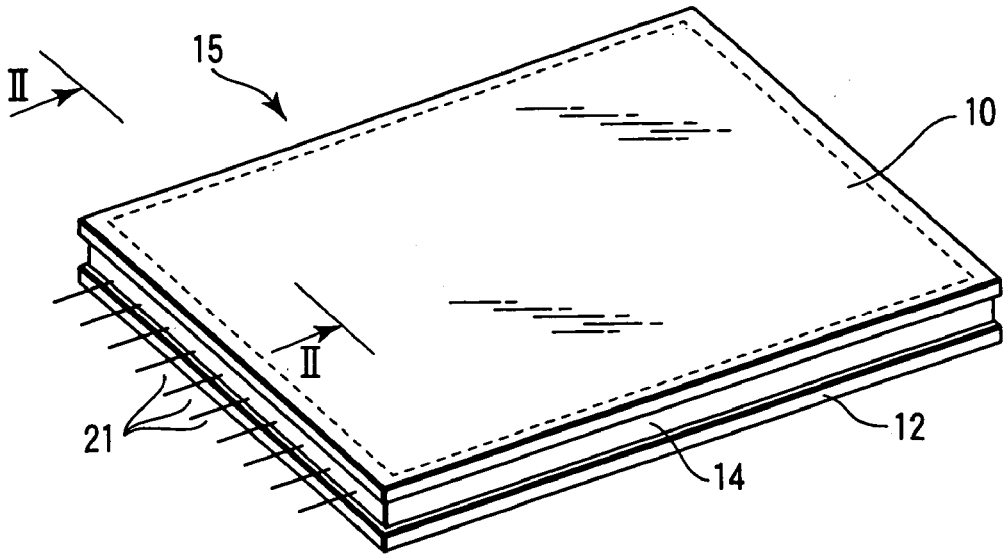
FIG. 1 is a perspective view showing an SED according to an embodiment of this invention.
Figure 2:
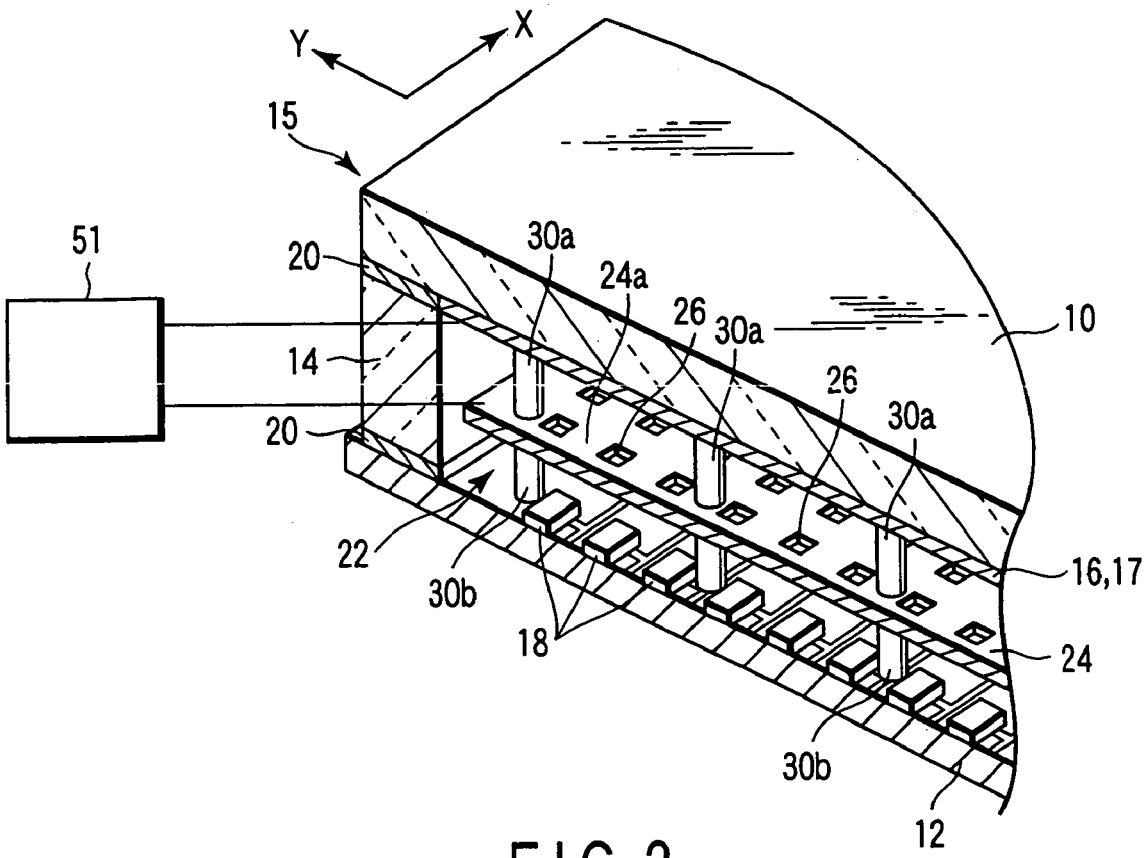
FIG. 2 is a perspective view of the SED, cut along line II—II of FIG. 1.
Figure 3:
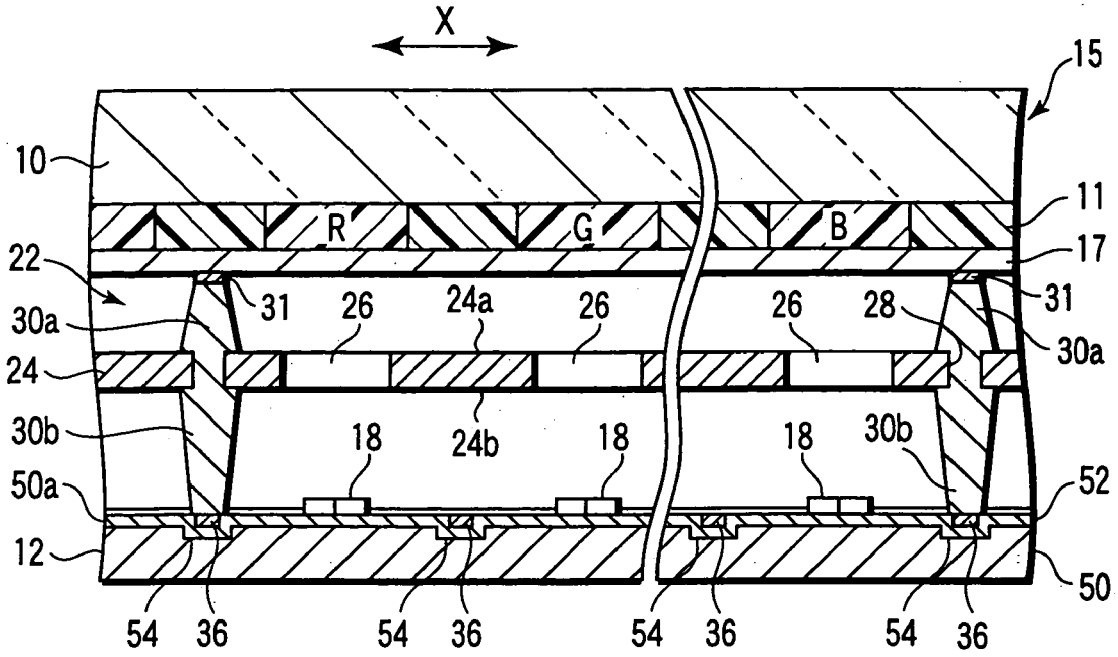
FIG. 3 is an enlarge sectional view showing the SED.

As shown in FIGS. 1 to 3, the SED comprises first and second rectangular substrates 10 and 12, which are opposed to each other with a gap of about 1.0 to 2.0 mm between them. The first substrate 10 is formed of a glass plate as a transparent insulating substrate. As mentioned later, the second substrate 12 is formed of a composite material that is obtained by coating a metal substrate having a thickness of about 0.1 to 0.5 mm with an insulating material. It is formed having a size a little greater than that of the first substrate 10. The first and second substrates 10 and 12 have their respective peripheral edge portions joined together by means of glass sidewall 14 in the form of a rectangular frame, and constitute a fat, rectangular vacuum envelope 15 that is kept in a vacuum inside. The sidewall 14 may alternatively be formed of metal that is coated with an insulating material.

A phosphor screen 16 for use as an image display surface is formed on the inner surface of the first substrate 10. The phosphor screen 16 is formed by arranging phosphor layers R, G and B, which glows red, blue, and green, respectively, as they are hit by electrons, and light shielding layers 11. The phosphor layers R, G and B are in the form of stripes or dots. A metal back 17 of aluminum or the like and a getter film (not shown) are formed in succession on the phosphor screen 16. A transparent electrically conductive film or color filter film of, for example, ITO may be provided between the first substrate 10 and the phosphor screen.

The sidewall 14 that serves as a joining member is sealed to the respective peripheral edge portions of the second substrate 12 and the first substrate 10 with a sealant 20 of, for example, low-melting glass or low-melting metal, and joins the first and second substrates together.

As shown in FIGS. 2 and 3, moreover, the SED comprises a spacer assembly 22 that is located between the first substrate 10 and the second substrate 12. The spacer assembly 22 is provided with a sheetlike grid 24 and a plurality of columnar spacers that are set up integrally on the opposite sides of the grid.

More specifically, the grid 24 has a first surface 24*a* opposed to the inner surface of the first substrate 10 and a second surface 24*b* opposed to the inner surface of the second substrate 12, and is located parallel to those substrates. The grid 24 is formed of iron or an alloy that is based mainly on iron and contains nickel and/or chromium.

A large number of electron beam passage apertures 26 and a plurality of spacer openings 28 are formed in the grid 24 by etching or the like. The electron beam passage apertures 26, which function as apertures of this invention, are arranged opposite electron emitting elements 18, individually. Further, the spacer openings 28 are located individually between the electron beam passage apertures and arranged at given pitches.

A first spacer 30*a* is set up integrally on the first surface 24*a* of the grid 24, overlapping each corresponding spacer opening 28. An indium layer is spread on the extended end of each first spacer 30*a*, and forms a height leveling layer 31 that eases the dispersion of the spacer height. The extended end of each first spacer 30*a* abuts against the inner surface of the first substrate 10 across the height leveling layer 31, getter film, metal back 17, and light shielding layers 11 of the phosphor screen 16. The material of the height leveling layer 31 is not limited to metal, and may be any other one that never influences the paths of electron beams and has suitable hardness for the effect of easing the dispersion of the spacer height. Naturally, the height leveling layer 31 is unnecessary if the spacers themselves can restrain the dispersion in height.

A second spacer 30*b* is set up integrally on the second surface 24*b* of the grid 24, overlapping each corresponding spacer opening 28, and its extended end abuts against the inner surface of the second substrate 12. Each spacer opening 28 and the first and second spacers 30*a* and 30*b* are situated in line with one another, and the first and second spacers are coupled integrally to each other by means of the spacer opening 28. Thus, the first and second spacers 30*a* and 30*b* are formed integrally with the grid 24 in a manner such that the grid 24 is sandwiched from both sides between them. Each of the first and second spacers 30*a* and 30*b* is tapered so that its diameter is reduced from the side of the grid 24 toward the extended end.

As shown in FIGS. 2 and 3, the spacer assembly 22 constructed in this manner is located between the first substrate 10 and the second substrate 12. As the first and second spacers 30*a* and 30*b* engage the respective inner surfaces of the first substrate 10 and the second substrate 12; they support atmospheric load that acts on these substrates, thereby keeping the distance between the substrates at a given value.

Figure 4:
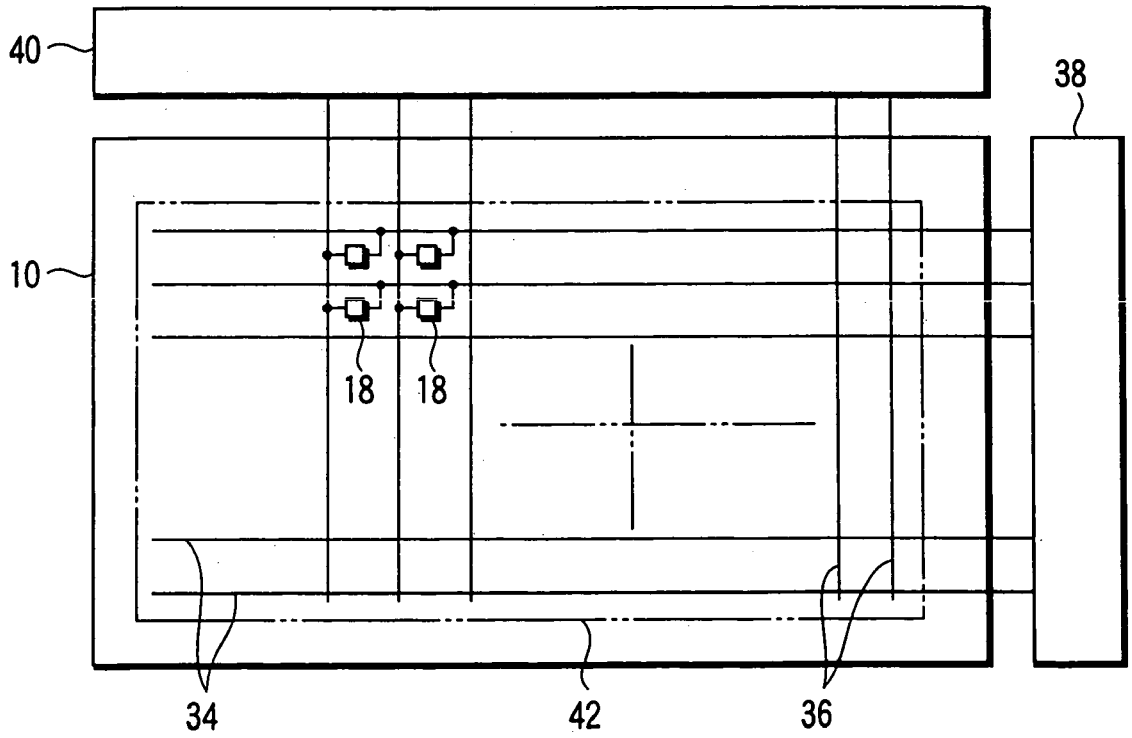
FIG. 4 is a plan view showing an array of wires and electron emitting elements on a second substrate of the SED.

As shown in FIGS. 2 to 4, a large number of electron emitting elements 18 are provided on the inner surface of the second substrate 12. They individually emit electron beams as electron sources that excite the phosphor layers of the phosphor screen 16. These electron emitting elements 18 are arranged in a plurality of columns and a plurality of rows corresponding to individual pixels. Each electron emitting element 18 includes an electron emitting portion (not shown), a pair of element electrodes that apply voltage to the electron emitting portion, etc.

A large number of internal wires for applying voltage to the electron emitting elements 18 are formed in a matrix on the second substrate 12. More specifically, as shown in FIGS. 3 and 4, a large number of scanning wires (X-wires) 34, which extend parallel to one another in a longitudinal direction X of the second substrate, and a large number of signal wires (Y-wires) 36, which extend along a direction Y perpendicular to the scanning wires 34, are formed on the inner surface of the second substrate 12. The scanning wires 34 are 480 in number, and the signal wires 36 are 640×3. Their wiring pitches are 900 μm and 300 μm, respectively.

One end of each scanning wire 34 is connected to a scanning line drive circuit 38, and one end of each signal wire 36 is connected to a signal line drive circuit 40. The scanning line drive circuit 38 supplies a drive voltage for drivingly controlling the electron emitting elements 18 to the scanning wires 34, while the signal line drive circuit. 40 supplies a display signal voltage to the signal wires 36.

In a display region 42 indicated by two-dot chain line in FIG. 4, the electron emitting elements 18 are connected individually to the intersections of the scanning wires 34 and the signal wires 36, thereby forming pixels. The electron emitting elements 18 arranged along the scanning wires 34 are 640×3 in number, and those arranged along the signal wires 36 are 480.

As shown in FIG. 2, the SED is provided with a power supply unit 51 that applies an anode voltage to the grid 24 and the metal back 17 of the first substrate 10. The power supply unit 51 is connected to the grid 24 and the metal back 17, and applies voltages of 12 kV and 10 kV to the grid 24 and the metal back 17, respectively. In displaying an image on this SED, the anode voltage is applied to the phosphor screen 16 and the metal back 17, and electron beams emitted from the electron emitting elements 18 are accelerated and run against the phosphor screen 16 by the anode voltage. Thereupon, the phosphor layers of the phosphor screen 16 are excited to glow, and the image is displayed.

As mentioned before, the second substrate 12 of the SED is formed of a composite material that is obtained by coating a metal substrate with an insulating material. As is evident from FIG. 3, the second substrate 12 is provided with a metal substrate 50 having a thickness of about 0.1 to 0.5 mm, for example, and an insulating layer 52. The insulating layer 52 is formed by coating on that surface of the metal substrate which faces at least the first substrate of the metal substrate, that is, a setting surface 50*a* on which the electron emitting elements 18 are arranged. The metal substrate 50 is formed of the same material of the grid 24, e.g., iron or an alloy that is based mainly on iron and contains nickel and/or chromium. The insulating layer 52 is formed by the liquid-phase precipitation method, open-to-atmosphere chemical vapor deposition method, evaporation method, or spray coating method.

The setting surface 50*a* of the metal substrate 50 is formed having a large number of grooves 54 that extend parallel to one another in the direction Y, and the insulating layer 52 is formed overlapping these groves. The electron emitting elements 18, scanning wires 34, and signal wires 36 are arranged on the insulating layer 52. In the present embodiment, the signal wires 36 are formed on the insulating layer 52 in a manner such that they are situated in the grooves 54, individually. The metal substrate 50 of the second substrate 12 is connected to the ground (not shown) and electrically grounded.

Figure 5A:
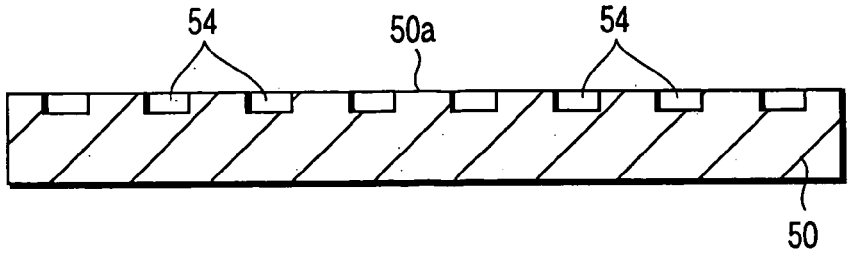
FIGS. 5A to 5C are sectional views schematically showing manufacturing processes for the second substrate of the SED.

The second substrate 12 constructed in this manner is manufactured in the following processes. First, Fe-50% Ni (containing unavoidable impurities) is rolled to a thickness of 0.25 mm, whereby a metal plate of a given size is formed, as shown in FIG. 5A. Then, the grooves 54 having a depth of 0.1 mm, width of 0.15 m, and pitch of 0.615 mm are formed on one surface (setting surface 50*a*) of the metal plate by the photo-etching method. Thereafter, the metal plate is leveled as it is cut to a given size, whereby the metal substrate 50 is obtained.

Figure 5B:
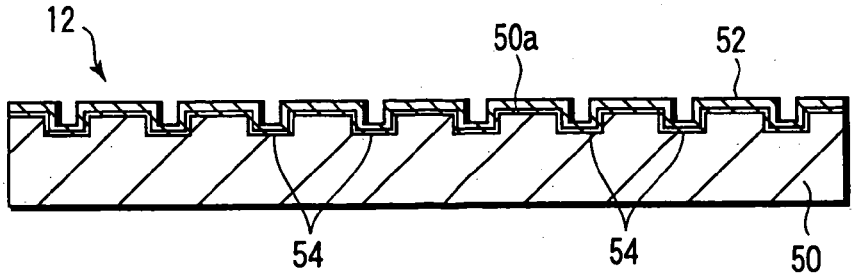

Subsequently, the metal substrate 50 is oxidation-treated in an oxidizing atmosphere, whereby an oxide film of $Fe_3O_4$ and $Fe_2NiO_4$ is formed on the setting surface 50*a* of the metal substrate, as shown in FIG. 5B. Then, a liquid that contains Li-based borosilicate alkali glass is spread on the oxide film of the metal substrate 50 by using a two-fluid nozzle of an ultrafine-particle type, and the insulating layer 52 is formed by drying and firing it. Further, the metal substrate 50 is dipped in an alkoxide solution of silicon, drawn up, and fired. Thereupon, an $SiO_2$ film is formed on the insulating layer 52, which is formed of the Li-based borosilicate alkali glass, and serves as a part of the metal substrate.

Figure 5C:
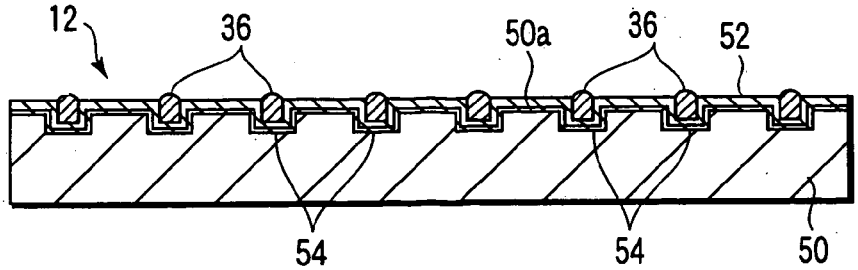

Subsequently, an electrically conductive paste that contains Ag is filled into the grooves 54 via the $SiO_2$ film and the insulating layer 52, and the signal wires 36 are formed by drying and firing the paste, as shown in FIG. 5C. Thereafter, the second substrate 12 is obtained by forming the remaining wires and the electron emitting elements 18 on the insulating layer 52 that includes the $SiO_2$ film by an existing process.

According to the SED constructed in this manner, the second substrate 12 is formed of the metal substrate 50 and the insulating layer 52 that is formed on its surface by coating. As compared with a case where the glass plate is used, therefore, the mechanical strength of the second substrate can be enhanced considerably. Thus, when compared with the case where the glass plate is used, the thickness of the second substrate 12 can be reduced substantially to 1/10 or less, so that the entire SED can be made thinner and lighter in weight. At the same time, the second substrate 12, compared with the glass plate, can be worked more easily and ensures easier formation of the wires and the like, so that its manufacturing cost can be lowered. Moreover, the second substrate 12 is not readily breakable, so that it can be easily handled during the manufacturing processes.

The grooves 54 are formed on the setting surface 50*a* of the second substrate 12, and the signal wires 36 are arranged in these grooves with the interposition of the insulating layer 52, whereby the second substrate 12 can be further thinned. The signal wires 36 may be formed on the insulating layer 52 without providing the grooves 54.

Figure 6:
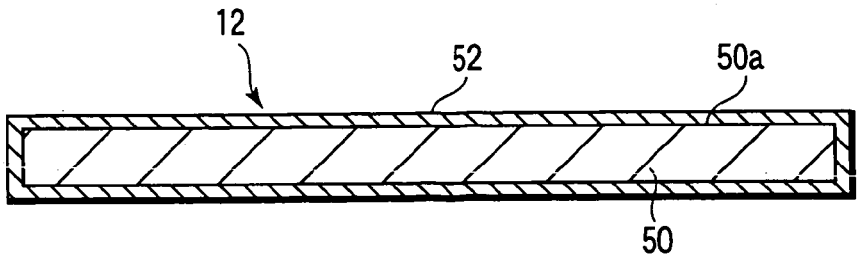
FIG. 6 is a sectional view showing a second substrate according to another embodiment.

In the second substrate 12, the insulating layer 52 is provided only on the side of the setting surface 50*a* of the metal substrate 50. Alternatively, however, the whole outer surface of the metal substrate 50 may be covered by the insulating layer 52, as shown in FIG. 6.

In this case, the second substrate 12 can be manufactured in the following processes. First, Fe-50% Ni (containing unavoidable impurities) is rolled to a thickness of 0.25 mm and leveled as it is cut to a given size, whereby the metal substrate 50 is formed. Thereafter, the metal substrate 50 is subjected to chemical treatment, whereupon a blackened film having an OH group is formed on the surface of the metal substrate.

Subsequently, the metal substrate 50 is immersed in hydrosilicofluoric acid of 25° C. that is supersaturated with silicon dioxide, whereupon the insulating layer 52 of $SiO_2$ is formed on the surface of the metal substrate. Further, the insulating layer 52 of $SiO_2$ is heat-treated to be densified in the atmosphere at 400° C. or more. This densification treatment may be omitted. Thereafter, the wires and the electron emitting elements are formed on the insulating layer 52 by an existing process, whereby the second substrate 12 is obtained.

The same function and effect of the foregoing first embodiment can be obtained even with use of the second substrate 12 constructed in this manner.

Figure 7:
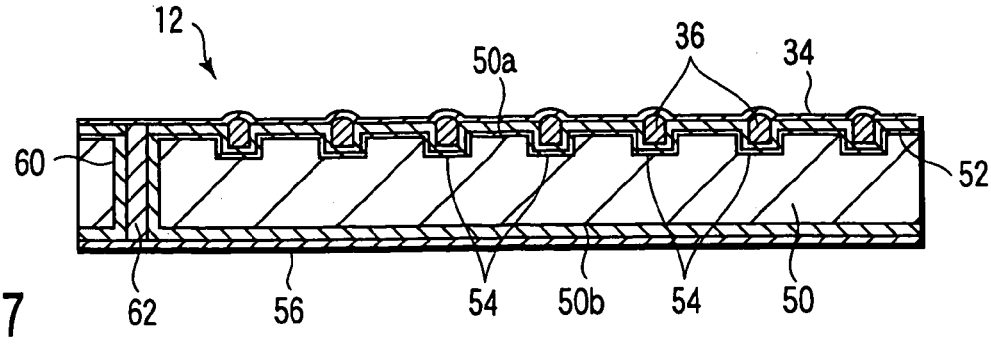
FIG. 7 is a sectional view showing a second substrate according to still another embodiment.

As shown in FIG. 7, the second substrate 12 may be constructed having back wires formed on its back. More specifically, the second substrate 12 has a metal substrate 50 and an insulating layer 52 that covers a setting surface 50*a* and a back surface 50*b* of the metal substrate 50. As in the foregoing embodiment, a large number of scanning wires 34, signal wires 36, and electron emitting elements 18 are formed on the setting surface 50*a*, while a large number of back wires 56 are formed on the side of the back surface 50*b*. In the present embodiment, the back wires 56 extend parallel to the scanning wires 34.

A large number of through holes 60 are formed at given pitches in one end portion of the second substrate 12. Each through hole 60 is filled with an electrical conductor, which forms an electrically conductive portion 62. Each back wire 56 is connected to a scanning wire 34 through its corresponding electrically conductive portion 62.

The second substrate 12 constructed in this manner can be manufactured in the following processes. First, aluminum-killed steel is rolled to a thickness of 0.12 mm, and the through holes 60 with a diameter of 0.1 mm are formed at pitches of 0.615 in the rolled metal plate by the photo-etching method. Thereafter, the metal plate is leveled as it is cut to a given size, whereby the metal substrate 50 is obtained.

Subsequently, the metal substrate 50 is oxidation-treated in an oxidizing atmosphere, whereby an oxide film of $Fe_3O_4$ and/or $Fe_2NiO_4$ is formed on the setting surface 50*a* and back surface 50*b* of the metal substrate. Then, a liquid that contains Li-based borosilicate alkali glass is spread on the oxide film of the metal substrate 50 by using a two-fluid nozzle of a fine-particle type, and the insulating layer 52 is formed on the setting surface 50*a* and the back surface 50*b* of the metal substrate 50 and the respective inner surfaces of the through holes 60 by drying and firing it. Further, the metal substrate 50 is dipped in an alkoxide solution of silicon, drawn up, and fired. Thereupon, an $SiO_2$ film is formed on the insulating layer 52 that is formed of the Li-based borosilicate alkali glass. Thereafter, an electrically conductive paste that contains Ag is filled as an electrical conductor into the through holes 60, and the electrically conductive portions 62 are formed by drying and firing the paste.

Subsequently, the scanning wires 34, signal wires 36, and electron emitting elements 18 are formed on the insulating layer 52 that includes the $SiO_2$ film, on the side of the setting surface 50*a*, by an existing process. As this is done, one end portion of each scanning wire 34 is formed overlapping one end of each through hole 60 and connected electrically to each electrically conductive portion 62.

After the SED is assembled with use of the second substrate, the back wires 56 are formed on the insulating layer 52, on the side of the back surface 50*b* of the second substrate 12. As this is done, one end portion of each back wire 56 is formed overlapping each through hole 60 and connected electrically to its corresponding scanning wire 34 through the through hole and the electrically conductive portion 62. The back wires 56 have a wiring resistance lower than that of internal wires, such as the scanning wires, signal wires, etc.

According to the SED provided with the second substrate 12 constructed in this manner, the same function and effect of the foregoing first embodiment can be obtained. In the present embodiment, the back of the scanning wires.

Further, this invention is not limited to the embodiments described above, and various modifications may be effected therein without departing from the scope of the invention. For example, this invention is not limited to an image display device that has a grid, and is also applicable to an image display device that has no grid. The dimensions, materials, etc. of the individual components may be suitably selected as required. The electron sources are not limited to the surface-conduction electron emitting elements, and may be selected variously from the field emission type, carbon nano tubes, etc. Further, this invention is not limited to the aforesaid SED, and is also applicable to any other flat image display devices, such as an FED, PDP, etc.

What is claimed is:

1. An image display device comprising an envelope which has a first substrate provided with an image display surface and a second substrate opposed to the first substrate with a gap and provided with a plurality of electron sources and is kept with a vacuum inside the gap, the second substrate being formed of a metal substrate which has a setting surface provided with the electron sources and covered by a first insulating layer, and a back surface opposed to the setting surface and covered by a second insulating layer, the second substrate being provided with a plurality of internal wires which are arranged on the setting surface of the metal substrate with the interposition of the first insulating layer and drive the electron sources, a plurality of back wires which have a wiring resistance lower than that of the internal wires and are arranged on the back surface of the metal substrate with the interposition of the second insulating layer, and plurality of through holes formed penetrating the metal substrate and the first insulating layer, and electrically conductive portions which are located individually in the through holes and electrically connect the internal wires and the back wires.

2. The image display device according to claim 1, wherein the metal substrate is formed of iron or an alloy based mainly on iron and containing nickel and/or chromium.

3. The image display device according to claim 2, wherein the metal substrate is doped with at least one of materials including aluminum, silicon, and manganese.

4. The image display device according to claim 1, wherein the metal substrate has a plurality of grooves formed on the setting surface, and the wires are located individually in the grooves with the interposition of the first insulating layer.

5. The image display device according to claim 1, wherein the metal substrate is electrically grounded.

6. The image display device according to claim 1, wherein the electron sources comprise surface-conduction electron emitting elements.

7. The image display device according to claim 1, which further comprises a plurality of spacers which are arranged between the first substrate and the second substrate and support atmospheric load acting on the first substrate and the second substrate, a grid which is located between and opposite the first substrate and the second substrate and has a plurality of apertures through which electrons emitted from the electron sources are transmitted, the spacers being formed integrally with the grid.

8. The image display device according to claim 7, wherein the metal substrate is formed of the same material as the grid.

9. The image display device according to claim 1, wherein the first insulating layer includes an insulating layer which is situated between the metal substrate and the electron sources and formed of SiO2.

* * * * *